United States Patent [19]

Carroll

[11] 3,965,633

[45] June 29, 1976

[54] INSULATED ROOFING STRUCTURE AND METHOD

[75] Inventor: Frank E. Carroll, Barrington, Ill.

[73] Assignee: Decks, Incorporated, Rolling Meadows, Ill.

[22] Filed: July 8, 1974

[21] Appl. No.: 486,444

Related U.S. Application Data

[63] Continuation-in-part of Ser. No. 457,996, April 4, 1974.

[52] U.S. Cl. ..... 52/309; 52/410; 52/434

[51] Int. Cl.[2] ..... E04B 1/24; E04C 2/10

[58] Field of Search ..... 52/309, 333, 405, 410, 52/335, 336, 338, 327, 328, 359, 360, 357, 351, 451, 411, 412, 434, 435; 52/90, 408, 409, 618

[56] References Cited

UNITED STATES PATENTS

| | | | |
|---|---|---|---|
| 2,861,525 | 11/1958 | Curtis | 52/309 |
| 3,029,172 | 4/1962 | Glass | 52/409 |
| 3,111,787 | 11/1963 | Chamberlain | 52/309 |
| 3,466,222 | 9/1969 | Curtis | 52/408 |
| 3,672,951 | 6/1972 | Moore | 52/309 |
| 3,763,614 | 10/1973 | Hyde | 52/309 |

FOREIGN PATENTS OR APPLICATIONS

| | | | |
|---|---|---|---|
| 910,156 | 11/1962 | United Kingdom | 52/309 |

*Primary Examiner*—John E. Murtagh
*Attorney, Agent, or Firm*—Thomas W. Speckman

[57] ABSTRACT

A fireproof insulated roofing sandwich type assembly having incombustible rigid gypsum formboard beneath and toward the interior of a building from a layer of synthetic polymer foam placed above to the exterior of the building from the rigid formboard and a waterproof wearing surface to the exterior of the synthetic polymer foam. The roofing assemblies of this invention provide Class 1 and hourly fire ratings to precast wood fiber cement-bonded boards. The roofing assembly of this invention is also suitable for installation over steel roof decks.

6 Claims, 2 Drawing Figures

INSULATED ROOFING STRUCTURE AND METHOD

CROSS REFERENCE TO RELATED APPLICATION

Figure 1:
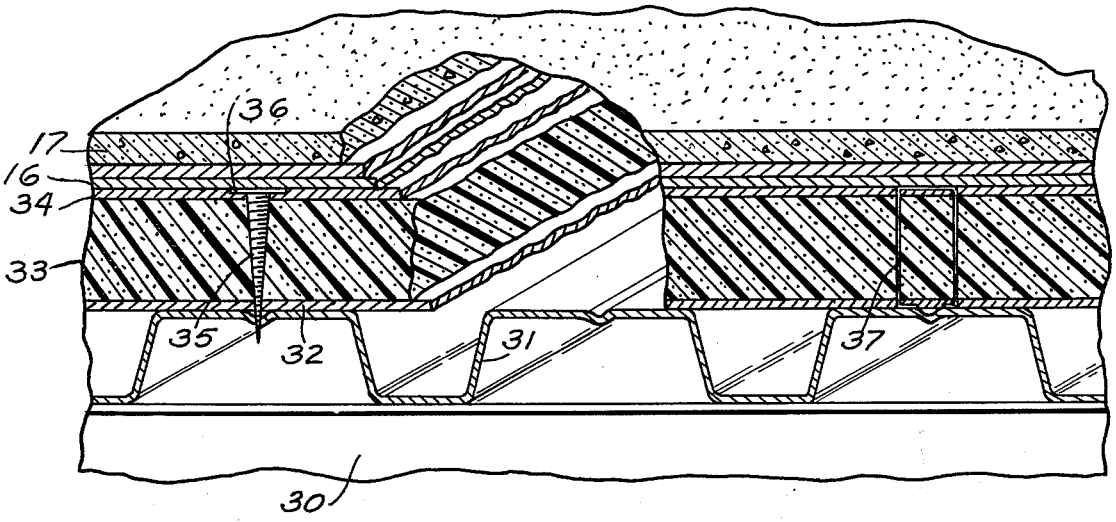

This application is a Continuation-in-Part of my pending application, Ser. No. 457,996, filed Apr. 4, 1974.

This invention relates to improved roof deck structures having high insulation properties. The roof structure of this invention provides superior fire protection than prior use of the components has provided. Particularly favorable fire protection and insulation properties are obtained utilizing the sheet metal structural shape of my prior application, Ser. No. 457,996.

Previously, most efficient integral insulation properties were obtained when conventional metal roof decks were installed followed by foam insulation covered with a weatherproof barrier or traffic layer, such as bitumen and roofing felt. However, such structures do contribute to the spread of a fire in a building under such a metal roof deck. U.S. Pat. No. 3,466,222 is illustrative of recent attempts to overcome such disadvantages. However, the structure shown in the 3,466,222 patent only slows down fire damage and does not eliminate it, the roof being susceptible to total destruction by the foam disintegrating and permitting the weatherproofing materials to burn even when utilizing an expensive metal deck roof system.

Polyurethane foam has also been utilized directly over a steel roof deck and due to its high melting point hot asphalt roofing can be applied directly over the polyurethane foam. This system has the disadvantages of difficult field installation with curling of the foam and only results in a Class 2 fire rating.

Another attempt has been to provide insulation beneath the metal roof deck structure, however, such insulation either adds to combustion in the interior of the building or is expensive if incombustible mineral fiber is used. Other attempts to provide both satisfactory insulation and fireproof properties have been to utilize insulation board which is both incombustible and has insulating properties. Such boards are those manufactured from mineral fiber materials and fiber glass materials, but these are both expensive and do not provide the desired insulation properties while being more difficult to use in field erection.

Other attempts to provide desired fire ratings and insulation properties have been to use precast roof slab boards of wood fibers bonded with inorganic hydraulic cement binder. While these materials are generally non-combustible, they do not by themselves have any hourly fire rating. It is also recognized that polyurethane foam has been laminated to such slab boards to provide desired insulation properties, but the material does not have any hourly fire rating by itself.

It is an object of this invention to overcome the above disadvantages.

It is another object of this invention to provide an economical insulating and Class 1 fire rated steel deck system.

It is yet another object of this invention to provide a sandwich panel roofing assembly of gypsum board — polymer foam — gypsum board for use in a wide variety of roof deck assemblies.

It is still another object of this invention to provide an insulating and hourly fire rated deck system utilizing cement-fiber roof deck boards which may advantageously use sheet metal structural shapes as purlins or sub-purlins.

Figure 2:
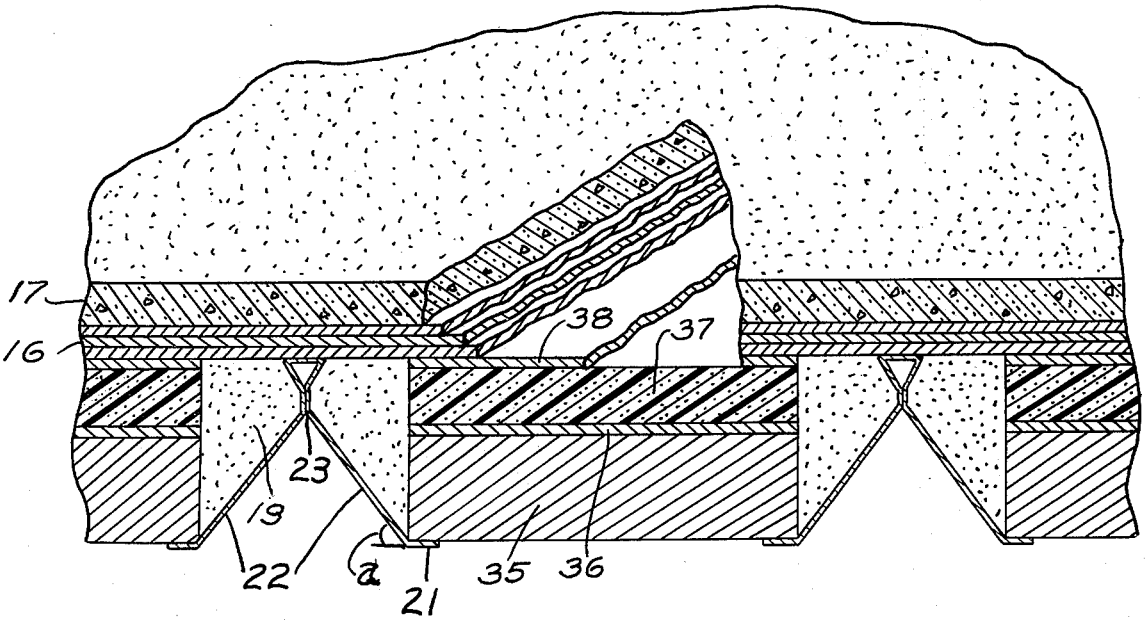

These and other objects, advantages and features of this invention will be apparent from the description and by reference to the drawings wherein preferred embodiments are shown as:

FIG. 1 is a perspective cut-away view of an insulated roofing structure of an embodiment of this invention using gypsum board and polymer foam assembly over a steel roof deck; and FIG. 2 is a perspective cut-away view showing an insulated roof deck construction utilizing a cement-fiber board — gypsum board — polymer foam assembly with sheet metal structural shape purlins or sub-purlins.

The roof deck construction of this invention provides insulated roof deck structures which in addition to furnishing a wide range of insulation properties to minimize energy requirements in the heating of structures, also provides roof deck structures having hourly or Class 1 fire ratings. Generally, the roof deck of this invention is made up, at least in part, of a sandwich type construction of incombustible rigid gypsum formboard on the bottom layer toward the interior of the building with synthetic polymer foam placed above, or to the exterior of the building, from the rigid formboard. A large number of specific embodiments based upon this construction are set forth in the following more detailed description.

Referring to FIG. 1, a steel roof deck construction is shown utilizing the principles of this invention. In FIG. 1, a conventional steel roof deck 31 is shown installed over roof support members 30. A sheet of rigid incombustible formboard 32 has its lower surface in contact with the upper surface of steel roof deck 31 and its upper surface in contact with the lower surface of synthetic polymer foam 33. Synthetic polymer foam 33 is shown having its upper surface in contact with the lower surface of rigid incombustible formboard 34. On top of formboard 34 is shown a built-up roofing membrance comprising alternate layers of roofing felt and hot asphalt shown as 16 with a waterproof wearing surface 17 of tar and gravel. Any suitable waterproof wearing surface for flat-type roofs is suitable for weatherproofing the upper surface of exterior roof decks according to this invention.

The rigid incombustible formboard may be any formboard providing an hourly fire rating, such as formboards of gypsum. Any gypsum formboard providing an hourly fire rating when used with poured gypsum slabs is suitable. The least expensive of the gypsum formboards, the rigid one-half inch thick gypsum formboard, is suitable for use in the roof structure of this invention, however, various surfaced gypsum formboards having suitable ceiling surfaces may be utilized as long as the incombustibility and flame spread ratings are satisfactory.

The synthetic organic polymer foam may be any substantially rigid organic polymer foam having good insulating properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polisocyanurate and the like. Preferred foams are selected from the group consisting of polystyrene and polyurethane. Especially preferred due to its higher melting point is polyurethane. Particularly suitable foams are closed cell foams which provide high insulating properties and low internal permeability to moisture. Such organic polymer foams are substantially rigid bodies of foam and are well known for their low density and outstanding thermal insulating properties.

Previously, use of organic polymer foams in roof structures has been limited due to the need for care and special attention in field installation if they are used alone and due to their decomposition at higher temperatures permitting structural damage. Principally, polyurethane has been used due to its higher melting point, but desired hourly or Class 1 fire ratings have not been obtained. In accordance with this invention these disadvantages are overcome, hourly or Class 1 fire ratings may be obtained and polystyrene may be advantageously utilized.

The organic polymeric foam and the rigid gypsum formboard roofers' insulation as used over the steel roof deck, may be preassembled by fastening the foam to the formboard by any suitable mechanical fastening means. Suitable fastening means include wire fasteners including staples and self-tapping screws, metal clips and the like. Wire fasteners are preferred. The polymer foam and rigid formboard may be assembled at the construction site by first laying the foamboard in place and placing the foam in place and mechanically fastening in the desired fashion.

It is preferred to preassemble the rigid formboard — organic polymeric foam assembly as roofers' insulation at a central production facility to both insure the superior quality control of the assembly and to afford savings in erection costs. When the fireproof insulation is to be installed over existing steel roof decks or field installed, it is preferred than an assembly of rigid formboard and polymeric foam be fabricated at a factory and installed as a unit over the steel roof deck. It is preferred that the assembly be mechanically fastened together such as by staples shown as 37 in FIG. 1, at the edges and center of the unit. Further, to enhance the unitized structure and to provide uplift resistance, it is preferred to fasten the roofers' insulation assembly to the metal roof deck with metal fastening mean such as self-tapping screws shown as 35 in FIG. 1 having either an enlarged head or washer 36. Self-tapping screw 35 goes through the insulation assembly and fastens it to the metal roof deck as well as securing the components of the insulation assembly together. Tapered polymeric foam may be utilized to provide desired slope of the roof deck surface for drainage. The entire metal roof deck – roofers' insulation assembly may be fabricated at a centralized factory and shipped completely assembled to the job site which minimizes field erection costs and assures high quality control. The factory assembled steel roof deck – roofers' insulation assembly may also utilize tapered polymeric foam to provide controlled slope to the upper roof deck surface to afford drainage.

In the past, serious difficulties have been encountered when using fiber glass or polyurethane insulation on top of steel roof decks in that the insulating material was not sufficiently rigid to bridge the gaps normally occurring in steel roof decks and thus, personnel walking on top of the fiber glass or polyurethane foam would damage it in applying the weatherproof seal to the roof. The roofers' insulation of this invention provides a sufficiently rigid structure to bridge the gaps normally present in steel roof deck construction to allow personnel to walk on top of the insulated structure to apply weatherproof seals.

Polystyrene, which is a highly efficient insulator and economical polymeric foam has not been practically usable in roofing insulation due to its relatively low melting point which causes the foam to fail when hot asphalt is poured directly on top of it and also to result in a roofing structure not providing a Class 1 fire rating.

However, in the roof structure of this invention, polystyrene may be utilized and is protected from heat caused by fire within a building by the gypsum board between the metal roof deck and the foam and is protected by heat from the hot asphalt by the gypsum board on top of the foam. Thus, an economical and highly insulating structure is provided utilizing polystyrene foam.

It is practical to apply hot asphalt roofs directly over the surface of polyurethane foams. Thus, when polyurethane is utilized as foam 33 as shown in FIG. 1, formboard 34 at the upper surface of the foam may be eliminated. However, formboard 32 at the lower surface of the foam must be provided to result in the desired hourly fire rating and to provide sufficient rigidity to the roofing insulation so that the gaps normally present in the steel roof deck may be adequately bridged.

FIG. 2 shows a roof deck construction according to this invention wherein sheet metal structural shapes more fully described in my co-pending patent application Ser. No. 457,996, are utilized. It is understood that the sub-purlins used in this invention may be of any conventional shape such as bulb tees, truss tees and the like, but the sheet metal structural shapes referred to above are preferred.

Briefly, the sheet metal shapes shown in FIG. 2 as sub-purlins or purlins are symmetrical about a vertical bisecting plane. The shape has a central vertical web 23 from which two legs 22 project downwardly for equal lengths at an angle, shown in FIG. 2 as "a", of about 45° to about 75° to the horizontal, preferably about 60° to about 75°. Each leg has a substantially horizontal flange 21 projecting outwardly at its lower extremity. The upper edge of web 23 has a structurally siffening member such as a flange or a triangle. I prefer an inverted isosceles triangle having its vertex at the top of the web and the opposite side substantially horizontal. This shape is more fully described in my co-pending patent application and the teachings thereof are incorporated herein by reference.

FIG. 2 shows a roof structure utilizing precast boards of long wood fibers bonded with inorganic cement binders. Such materials are presently available under the trademark Tectum sold by The Gold Bond Building Products Division of National Gypsum Company, Buffalo, New York, and PetriCal, sold by The Cornell Corporation, Cornell, Wisconsin. Although these materials are incombustible, they do not presently afford any hourly fire rating without protective ceiling assemblies. The roof structure of this invention obtains hourly fire ratings as a result of its own structure, that is, without the necessity of protective ceiling assemblies.

In the precast wood fiber cement-bonded board insulated roofing board of this invention, the wood fiber cement-bonded board is shown as 35 in FIG. 2 having bonded to its upper surface gypsum board 36. Above gypsum board 36 is foam insulation 37 having above it gypsum board 38. Gypsum board 36 is bonded to the precast wood fiber cement-bonded board 35 and thereby acts as a compression element of the slab. Use of gypsum board 38 at the upper surface of the polymeric foam makes it practical to utilize polystyrene foam. When polyurethane foam is used, upper gypsum board 38 may be omitted, if desired, and the sealing layer applied directly over the polyurethane. The spaces between the sides of adjacent roofing boards are filled with suitable grout 19. The grout further protects the insulation from exposure to the heat of a fire at the sides of the roofing boards of this invention. Conventional tar and gravel weather seal and wearing surface comprising layers 16 and 17 are applied directly over the roofing assembly. Such a structure results in an hourly fire rated roofing structure.

Gypsum board 36 is bonded to the precast wood fiber cement-bonded board 36 by any suitable adhesion agent. These two layers must be bonded in order for the gypsum board to act as a compression element of the slab. Suitable bonding agents include natural and synthetic adhesives such as epoxy, polyurethane, polyamide, polyvinylacetate and its co-polymers. Foam 37 and gypsum board 38 may be held to gypsum board 36 by mechanical means such as wire staples, nails and screws or may be bonded by the above disclosed adhesion agents. Stapling is preferred. The precast roof board assembly of this invention would conventionally be assembled in a factory and shipped to the construction site for installation, thus saving field labor costs and assuring quality control of a centralized assembly operation. Of course, if desired, the precast roof board assembly of this invention could be assembled at the construction site.

The precast roof board assemblies of this invention may be in the form of planks or tiles and the edges may be shaped to provide uplift resistance or may be tongue-and-groove.

The applicant is aware of present efforts to utilize precast wood fiber cement-bonded roofing boards to obtain insulated roofs by integrally bonding a layer of polyurethane to the upper surface of the wood fiber cement-bonded board. However, such materials do not result in an hourly fire rating unless a protective ceiling assembly is used. Such ceilings are expensive and also result in the loss of valuable space. The roof structure of this invention provides a roof structure which obtains an hourly fire rating as a result of its own structure and thus the lower side of the precast board may be utilized as the interior ceiling. This is especially suitable when the above described sheet metal structural shapes are utilized as purlins and sub-purlins are omitted.

The roof structures of this invention permit the use of thinner gypsum boards than previously used, ⅜ inch to ⅝ inch being suitable, ⅜ inch being preferred over metal roof deck to minimize weight and ½ inch over precast cement-bonded wood fiber slabs to provide strength. The polymeric foam thickness used in roof construction according to this invention may be varied to provide desired insulation and to provide utilization of desired foam materials. For example, polyurethane may be utilized with as thin a layer as ½ inch in structures such as shown in FIGS. 1 and 2, while polystyrene or polyurethane may be utilized in thicknesses as great as 6 or 8 inches to obtain desired insulation.

The roof structure of this invention provides properties which are presently being called for by newer building regulations. The first such property is fire ratings which, following suitable ASTM testing, result in hourly fire ratings for the roof structure. The second important property is thermal insulation combined with the satisfactory fire rating. Present energy conservation considerations result in a "U" value of 0.10 and less being desirable. An inexpensive roof deck is provided by this invention having both an hourly fire rating and insulation properties resulting in "U" values of 0.10 and less. Further, a range of desired insulating properties may be achieved by varying the thickness of the synthetic polymer foam.

Any suitable ceiling structure may be installed beneath the roof structure of this invention as long as suitable ventilation is furnished. However, in contrast to prior roof structures, it is not necessary that the ceiling provide the insulation or fireproofing qualities. The roof structure of this invention provides high insulation and fireproof properties without any structure beneath it and may be left exposed. Further, when the sheet metal shape shown is used directly as a purlin, about one foot of interior occupancy space is gained over conventional construction using exposed joists which must also be fireproofed.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A fireproof insulated roof structure comprising: roof support members, roof decking adjacent to and supported by said roof support members, incombustible rigid gypsum formboard above and adjacent to said roof decking, synthetic polymer foam above and adjacent to said formboard, and a waterproof wearing surface to the exterior of said foam, wherein the lower surface of said gypsum formboard is bonded to the upper surface of a precast wood fiber cement-bonded board roof decking.

2. The fireproof insulated roof structure of claim 1 wherein the rigid formboard is ½ inch thick.

3. The fireproof insulated roof structure of claim 1 wherein said synthetic polymer foam is selected from the group consisting of polystyrene and polyurethane.

4. The fireproof insulated roof structure of claim 3 wherein said foam is polystyrene and having a second rigid gypsum formboard between the upper surface of the polymer foam and the waterproof wearing surface.

5. The fireproof insulated roof structure of claim 3 wherein the foam is polyurethane and the waterproof wearing surface is applied directly to the upper surface of the polymer foam.

6. An insulated roof deck structure comprising:

a series of parallel sheet metal structural shapes which are symmetrical about a vertical bisecting plane having a central vertical web, two legs projecting downwardly from the bottom of said web at an angle of about 45° to about 75° to the horizontal, each leg having a substantially horizontal flange projecting outwardly at its lower extremity, and a stiffening member at the upper edge of said web;

roofing slab assembly having the lower surface of a precast wood fiber cement-bonded board resting on said horizontal flanges and extending between adjacent structural shapes and incombustible rigid gypsum formboard bonded to the upper surface of the precast board and having a layer of synthetic polymer foam above the gypsum formboard; and grouting between said roofing slab assemblies and around said stiffener providing uplift resistance.

* * * * *